United States Patent [19]

Sato

[11] 4,284,004

[45] Aug. 18, 1981

[54] TYPE CHARACTER SELECTING MECHANISM FOR PRINTING HEAD

[75] Inventor: Yo Sato, Tokyo, Japan

[73] Assignee: Kabushiki Kaisha Sato Kenkyusho, Japan

[21] Appl. No.: 86,056

[22] Filed: Oct. 18, 1979

[30] Foreign Application Priority Data

Oct. 20, 1978 [JP] Japan ..... 53-143339[U]

[51] Int. Cl.[3] ..... B41J 1/20

[52] U.S. Cl. ..... 101/111; 101/105; 101/110

[58] Field of Search ..... 101/110, 111, 105, 106, 101/107, 108, 99, 100, 101

[56] References Cited

U.S. PATENT DOCUMENTS

| | | | |
|---|---|---|---|
| 3,482,512 | 12/1969 | Jung | 101/110 |
| 3,521,556 | 7/1970 | Barbour | 101/99 X |
| 4,023,485 | 5/1977 | Kirby, Jr. | 101/111 |
| 4,041,863 | 8/1977 | Mullen et al. | 101/100 X |
| 4,084,507 | 4/1978 | Sato | 101/110 |
| 4,094,244 | 6/1978 | Edwards et al. | 101/110 X |
| 4,163,422 | 8/1979 | Hamisch, Jr. | 101/105 X |
| 4,170,938 | 10/1979 | Sato | 101/111 |

FOREIGN PATENT DOCUMENTS

| | | | |
|---|---|---|---|
| 2704584 | 10/1978 | Fed. Rep. of Germany | 101/111 |

*Primary Examiner*—Edgar S. Burr
*Assistant Examiner*—C. A. Pearson
*Attorney, Agent, or Firm*—Ostrolenk, Faber, Gerb & Soffen

[57] ABSTRACT

A type character selecting mechanism for use in a printing head which is equipped with a plurality of juxtaposed endless bands bearing type characters on their outer surfaces. The mechanism includes a plurality of juxtaposed selecting gears engageable with the corresponding endless bands for turning the same. Each of the selecting gears is formed on its inner side with a series of internal teeth. A selecting shaft is axially slidable through coaxial holes of the gears and is rotatable. The selecting shaft has a locking member at its inner end which is engageable with the internal teeth of one of the gears for locking the same in position. The type characters borne on the two outer bands are semi-fixed; the type characters borne on the remaining inner bands are changeable. The selecting gears for turning the outer bands have their internal teeth angularly displaced from internal teeth of the selecting gears for turning the remaining inner bands. Positioning means is provided for locking one of the inner gears so that the internal teeth thereof are aligned with those of one of the outer gears. Thus, the selecting shaft can be prevented from being erroneously moved between one of the outer gears and the adjacent one of the remaining gears.

15 Claims, 5 Drawing Figures

TYPE CHARACTER SELECTING MECHANISM FOR PRINTING HEAD

BACKGROUND OF THE INVENTION

1. Field of the Invention

The present invention relates to a type character selecting mechanism for a printing head to be used with a portable label printing and applying machine which is often referred to as a hand labeler or tagging machine.

2. Description of the Prior Art

In printing heads mounted in hand labelers or tagging machines, generally, a plurality of type bands or type rings bearing type characters on their outer surfaces are juxtaposed on a common axis. A desired band or ring is selected therefrom by means of a selecting knob or the like and is turned to select a desired type character for printing.

Recently, the so-called "POS" (i.e., Point of Sales System) has been developed, using a printing head for bar codes to be optically read. The bar codes are composed of symbol marks, each of which has several characters each indicating numerals from 0 to 9. But their specific structures and configurations have not yet been standardized and include a variety of systems for various codes. Some of such codes have been referred to as UPC, WPC and JAN.

However, most patterns are shared among these code systems. These patterns however permit selected inner characters to be interchangeable in order to provide information including a manufacturer or source code or a commodity code. Selected outer characters are either fixed since they are not expected to be changed or are, in effect, semi-fixed since they are seldom expected to be changed. The latter include guard codes, start codes, end codes or check codes.

In the bar code printing head according to the prior art, the type character selecting mechanism for the afore-mentioned semi-fixed characters has a construction identical to that of the type character selecting mechanism for the afore-mentioned changeable characters. A selecting knob is moved to slide in its axial direction to select one of the semi-fixed character bands or rings and the selecting knob is then turned to select the desired one of the characters. As a result, since the type selecting operations for both the changeable and semi-fixed types are common, an operator is liable to erroneously change the semi-fixed type characters, even when such change is not necessary, so that an erroneous print frequently results.

SUMMARY OF THE INVENTION

It is therefore an object of the present invention to provide a type character selecting mechanism for use with a printing head, which mechanism will prevent erroneous and undesired resetting of semi-fixed type characters and which will obviate the afore-mentioned difficulties.

A major object of the present invention is to provide a type character selecting mechanism in which the possibility that an operator will erroneously change the semi-fixed type characters is precluded by providing a preset obstruction to interrupt the transition between the changeable type character selecting operation and the semi-fixed type character selecting operation whereby the desired precise printing operation can always be accomplished.

As a major feature of the present invention, a type character selecting mechanism for use in a printing head is provided including a plurality of printing elements juxtaposed to one another and each bearing a series of type characters on its outer surface. The type character selecting mechanism comprises: a plurality of annular selecting gears substantially coaxially juxtaposed to one another and rotatable about their common axis with the printing elements of said printing head, respectively. Each of said selecting gears is formed on the side wall of the hole through it with a plurality of equidistantly spaced internal teeth. A selecting shaft is slidable through coaxial holes of said selecting gears in the direction of said common axis and rotatable about the common axis. The shaft has at its inner end a locking member which is positioned and sized to engage with the internal teeth of one of the selecting gears for locking the same in position. The improvement resides in that some of the selecting gears have their internal teeth angularly displaced from the internal teeth of the remaining selecting gears. Furthermore there is provided positioning means to stop one of the remaining selecting gears at such a position that the internal teeth thereof are aligned with the teeth of adjacent ones of certain of the selecting gears, whereby the selecting shaft can be prevented from being erroneously moved between one gear and the adjacent one of the remaining selecting gears unless the internal teeth of the two adjacent selecting gears are aligned by the positioning means.

BRIEF DESCRIPTION OF THE DRAWINGS

Other objects and advantages of the present invention will become apparent from the following description taken in connection with the accompanying drawings, in which.

DESCRIPTION OF THE PREFERRED EMBODIMENT

Figure 1:
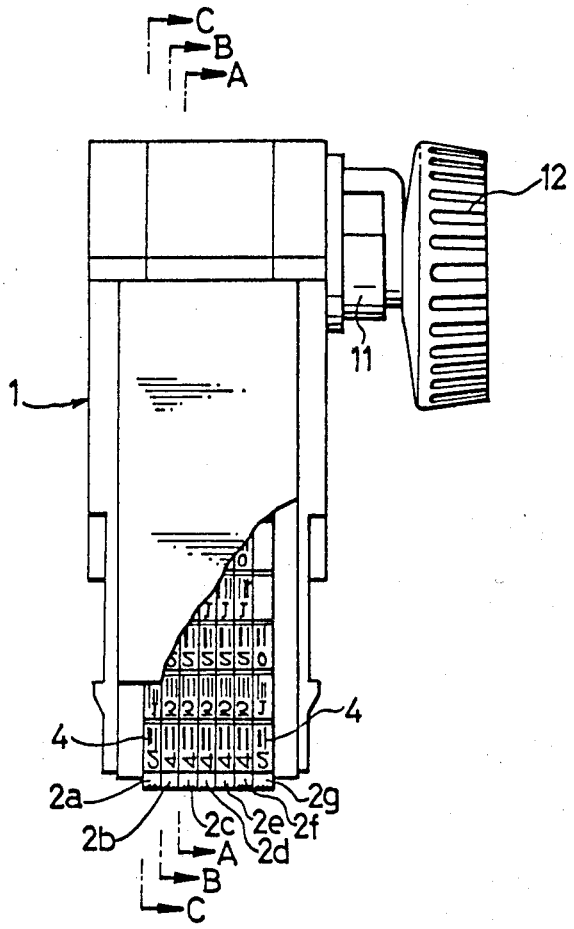
FIG. 1 is a front elevation showing a printing head, which is equipped with a type character selecting mechanism exemplifying the present invention, with a portion thereof being cut away.

Referring to the drawings, the printing head shown therein is a bar coding printing head which may be used with a hand labeler. The printing head has a frame 1, in which a plurality of type character bearing bands of the endless type 2*a* to 2*g* are juxtaposed to one another. Each of these type character bearing bands 2*a* to 2*g* has on its upper half index characters 3, such as letters or numerals, on its outer surface, and its lower half bears corresponding bar codes types 4 also on its outer surface. It should be noted here that both outer bands 2*a* and 2*g* are used to bear the aforementioned semi-fixed type characters whereas the inner bands 2*b* to 2*f* located between the outer bands are used to bear the afore-mentioned changeable type characters.

As better seen in FIGS. 2(A), 2(B), 3(A) and 3(B), the type character bearing bands 2*a* to 2*g* operate at their upper and lower ends, respectively, upon selecting gears 5, 5′ and 5″ and positioning members 6. The selecting gears 5, 5′ and 5″ and the positioning members 6 are provided in the same number of sets as type character bearing bands 2*a* to 2*g* and are also juxtaposed rotatably to one another.

Figure 2:
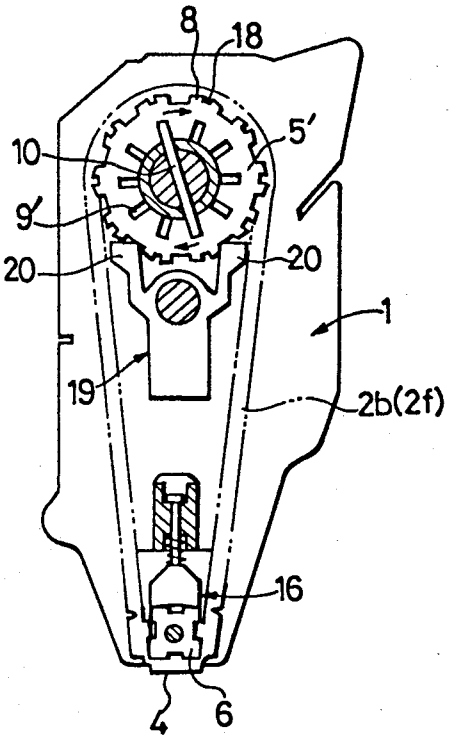
FIG. 2(A) is a section taken along line A—A of FIG. 1.
FIG. 2(B) is a simplified section taken along line B—B of FIG. 1.
Figure 2:
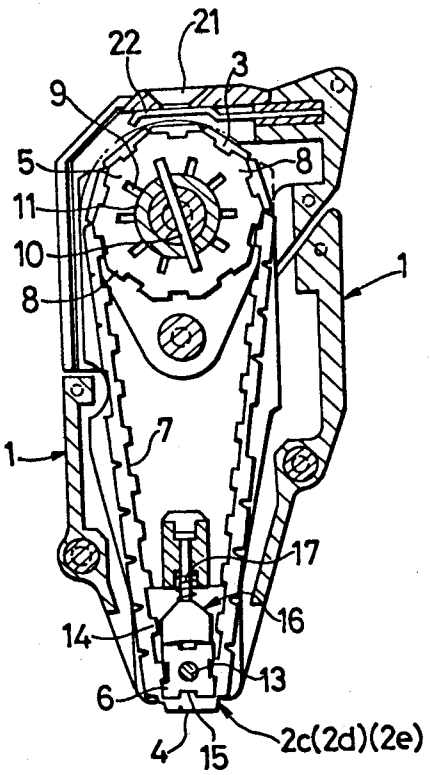

Each of the selecting gears 5 shown in FIG. 2(A) is formed on its outer circumference with a series of external teeth 8, which engage the engagement grooves 7 on the inner side of the inner bands 2*c*, 2*d* or 2*e* corresponding thereto. Each of the selecting gears 5 also has on its inner circumference a series of internal teeth 9 each of which is in register radially with one of the external teeth 8. A selecting shaft 11 is inserted through the selecting gears 5. The leading end of shaft 11 has affixed thereto a locking member 10. Locking member 10 can be operated into engagement with any two diametrically opposed internal teeth 9 of one of the selecting gears 5. The selecting shaft 11 is slidable axially thereof and rotatable about its axis so that it can select any type on any one of the bands 2*a* to 2*g*. This is accomplished by manually turning a selecting knob 12 which is attached to the outer end of the selecting shaft 11 outside of the printing head frame 1, as better seen from FIG. 1.

On the other hand, the afore-mentioned positioning member 6 is mounted rotatably on a pin 13 and is formed on its outer surface with engagement grooves 15 which are shaped and sized to engage with the engagement bands 14 formed on the inner side of each of the type character bearing bands, as indicated generally at 2. Above the positioning member 6, thus formed, there is disposed an elastic stopper 16 which is always brought into abutment contact with the positioning member 6 by the biasing force of a coil spring 17.

The selecting gears 5 which are positioned to engage and operate the inner bands 2*c*, 2*d* and 2*e*, on the one hand, and the selecting gears 5′ and 5″, which are positioned to engage and operate the intermediate bands 2*b* and 2*f* and the outer bands 2*a* and 2*g*, respectively, on the other hand, have slightly different construction.

Figure 3:
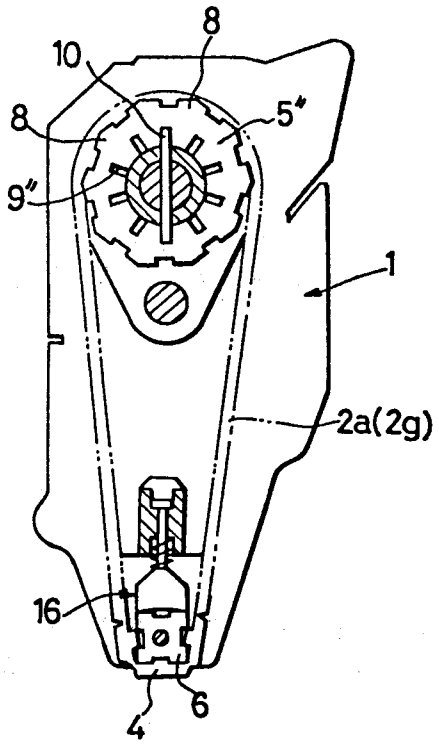
FIG. 3(A) is similar to FIG. 2(B) but shows the condition under which a selecting shaft is turned a half pitch from the condition of FIG. 2(B)
FIG. 3(B) is a simplified section taken along line C—C of FIG. 1.
Figure 3:
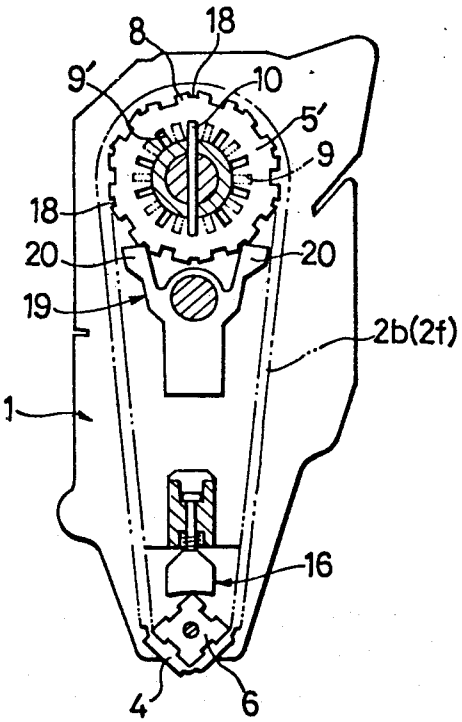

Each of the intermediate selecting gears 5′ is positioned as shown in FIGS. 2(B) and 3(A), to operate one of the type character bearing bands 2*b* and 2*f* and is substantially similar to the selecting gears 5 except for the fact that a positioning notch 18 is additionally formed at the center of the outer end of each external tooth 8 of each selecting gear 5′. Below each intermediate selecting gear 5′, there is fixed a positioning fork 19 which is formed with a pair of flexible pawls 20.

Turning to FIG. 3(B), the side selecting gears 5″ are positioned to operate the outer bands 2*a* and 2*g* which bear the semi-fixed type characters. Each of the side selecting gears 5″ has the same external teeth as those of the inner selecting gear 5 but is different therefrom in that its internal teeth 9″ are each located at the midpoint between any two adjacent external teeth 8 and are thus radially displaced therefrom.

This is in contrast to internal teeth 9 and 9′ which are each radially aligned with the respective external teeth 8.

The operation of the type character selecting mechanism according to the present invention is as follows. The type characters of the inner and intermediate bands 2*b* to 2*f* are expected to be frequently changed in accordance with the kinds of commodities to which the proper bar codes are to be applied. For this purpose, the selecting knob 12 is first moved manually to slide the selecting shaft 11 axially thereof until the locking member 10 at the leading end thereof is positioned in the internal teeth 9 of the desired band 2*b*, 2*c*, 2*d*, 2*e* or 2*f*. This manual sliding operation can be performed by shifting a suitable indicator 22, which is attached to the selecting shaft 11 and is formed into an arrow. Looking into a peep aperture 21 which is formed in the upper side of the printing head frame 1, until the indicator 22 comes into alignment with the desired band will provide a signal to the user that the band is ready to be moved or changed.

The selecting knob 12 is turned so that the selecting band is moved until the desired index character 3 appears in the peep aperture 21. Thus, the desired type 4 is positioned at the lowermost printing position by the action of the positioning member 6, as shown in FIG. 2(A).

On the other hand, in the event that it is intended to change the types 4 of the bands 2*a* or 2*g* bearing the semi-fixed type characters, the selecting knob 12 is axially moved until its locking member 10 is positioned in the internal teeth 9′ of the selecting gear 5′ which corresponds to the intermediate band 2*b* or 2*f* adjacent the outer bands 2*a* or 2*g*, as shown in FIG. 2(B). Since the internal teeth 9′ of the intermediate selecting gear 5′ are angularly displaced from the internal teeth 9″ of the selecting gear 5″ corresponding to the outer bands 2*a* or 2*g*, the locking member 10 of the selecting knob 12 is never brought into engagement with the internal teeth 9″ of the side selecting gear 5″ even if the knob 12 is shifted as far as possible. As a result, it is sufficient that the selecting knob 12 be shifted until its locking member 10 abuts against the inner side of the selecting gear 5″ corresponding to the outer bands 2*a* or 2*g*.

Then if the selecting knob 12 is turned slightly from the position shown in FIG. 2(B), the positioning fork 19 brings its flexible pawls 20 into engagement with the positioning notches 18, which are formed in the outer edges of the intermediate selecting gear 5′ corresponding to the intermediate bands 2*b* or 2*f*, so that this selecting gear 5′ is stopped in position. In this instance, more specifically, it is sufficient that the selecting knob 12 is turned a half of one type character (or "a half pitch"), as seen from FIG. 3(A).

Under this particular condition, the selecting gears 5′ and 5″ have their internal teeth 9′ and 9″ registered with each other so that the selecting knob 12 can be further moved to bring its locking member 10 from the internal teeth 9′ to the internal teeth 9″, as shown in FIG. 3(B). Under this condition, the selecting knob 12 is turned so that the desired type 4 can be selected from the semi-fixed type character bearing band 2*a* or 2*g*, which now is connected with the locking member through the corresponding selecting gear 5″, and can be positioned at the lowermost printing position.

In order to return the locking member 10 of the selecting shaft 11 to inner center bands 2*c* to 2*e* bearing the changeable type characters, the selecting knob 12 operation is reversed and it is returned axially inwardly thereof to bring the locking member 10 out of the internal teeth 9″ of the side selecting gear 5″ into the internal teeth 9′ of the intermediate selecting gear 5′. Then, if the selecting gear 5′ is turned a half pitch by means of the selecting knob 12, its internal teeth 9′ restore registration with the internal teeth 9 of the center selecting gears 5. As a result, the return of the selecting knob 12 brings its locking member 10 into the internal teeth 9 of the desired one of the center selecting gears 5.

The desired type 4 of the intermediate band 2*b* or 2*f* is thereby brought from the condition of FIG. 3(A) to the condition of FIG. 2(B) by the half pitch rotation of the selecting gear 5' so that it can be used for the printing purpose.

Although, in the foregoing description, the type character selecting mechanism exemplifying the present invention is applied to a printing head of the type band type, it should be understood that the present invention is not to be limited to such application but can be used in a variety of printing heads, e.g. a printing head, in which printing elements bearing type characters are made integral with the selecting gears, as is disclosed in U.S. Application Ser. No. 790,144 (abandoned) owned by the present inventor or a printing head in which selecting gears formed with index characters are made coactive in meshing engagement with the type character bearing gears, as is disclosed in U.S. Pat. No. 4,084,507.

The present invention is, of course, not limited to the bar code printing head.

As has been previously described, an essential element of the present invention is that a preset obstruction is provided to interrupt the transition between the changeable type character selecting operation and the semi-fixed type character selecting operation. There is therefore no possibility that an operator will inadvertently change the semi-fixed type characters when such change is not necessary, so that the operator can always perform the desired precision printing operation and be secure in the fact that inadvertent or accidental displacememt of semi-fixed characters has not occurred.

Although the present invention has been described in connection with a preferred embodiment thereof, many variations and modifications will now become apparent to those skilled in the art. It is preferred, therefore, that the present invention be limited, not by the specific disclosure herein, but only by the appended claims.

What is claimed is:

1. A type character selecting mechanism for a printing head including a plurality of printing elements juxtaposed to one another and each bearing a series of type characters on its outer surface comprising: a plurality of annular selecting gears, one for each of said plurality of printing elements, substantially coaxially juxtaposed to one another and rotatable about their common axis with the printing elements of said printing head, respectively; coaxially aligned holes defined in said selecting gears; each of said selecting gear holes defining an inner side of said gear and each said inner side having a plurality of equidistantly spaced internal teeth;

a selecting shaft slidable through said coaxial holes of said selecting gears and rotatable about its axis, said shaft having thereon a locking member which is positioned and sized to engage with and which engages the internal teeth of one of said selecting gears, whereby rotation of said selecting shaft rotates the said gear then engaged by said locking member;

a first of said selecting gears having a first rotative orientation, at which its said internal teeth are axially aligned with the said internal teeth of a second group of said selecting gears, and having a second rotative orientation, at which its said internal teeth are angularly displaced from the said internal teeth of said second group of said selecting gears; and positioning means for locking said first selecting gear at either of said first and second rotative orientations; said selecting shaft being prevented from being erroneously moved between said second group of said selecting gears and said first selecting gear unless said first gear is at said first rotative orientation and said internal teeth of the two adjacent said selecting gears, including said first gear and the adjacent said gear of said second group, are aligned.

2. A type character selecting mechanism for a printing head including a plurality of printing elements juxtaposed to one another and each bearing a series of type characters on its outer surface comprising: a plurality of annular selecting gears substantially coaxially juxtaposed to one another and rotatable about their common axis with the printing elements of said printing head, respectively; coaxially aligned holes defined in said selecting gears; each of said selecting gear holes defining an inner side of said gear and each said inner side having a plurality of equidistantly spaced internal teeth; each of said selecting gears being formed on its outer side with a plurality of equidistantly spaced external teeth corresponding to the inner teeth thereof;

a selecting shaft slidable through said coaxial holes of said selecting gears and rotatable about the axis of said selecting shaft, said shaft having thereon a locking member which is positioned and sized to engage with and which engages the internal teeth of a selected one of said selecting gears, whereby rotation of said selecting shaft rotates the said gear then engaged by said locking member;

a first of said selecting gears having a first rotative orientation, at which its said internal teeth are axially aligned with the said internal teeth of a second group of said selecting gears, and having a second rotative orientation, at which its said internal teeth are angularly displaced from the said internal teeth of said second group of said selecting gears; and positioning means for locking said first selecting gear at either of said first and second rotative orientations;

a third one of said selecting gears having its said internal teeth normally angularly displaced from said internal teeth of said second group of said selecting gears at said second rotative orientation of said first selecting gear, said internal teeth of said first selecting gear are axially aligned with said internal teeth of said third selecting gear;

said first selecting gear being positioned between a said selecting gear of said second group and said third selecting gear, whereby movement of said locking member from one of a said gear of said second group and said third gear, which is located on one side of said first gear, to the other of a said gear of said second group and said third gear, which is located on the opposite side of said first gear, requires rotation of said first gear to said rotative orientation thereof at which said teeth of said first gear are axially aligned with the said teeth of the respective one of said gear of said second group and said third gears in which said locking member is located, shifting of said locking member into said internal teeth of said first gear and then rotation of said first gear to the said rotative orientation thereof at which said internal teeth of said first gear are axially aligned with the said internal teeth of the other of said gear of said second group and said third gear into which said locking member is to be moved, and then shifting said locking member into said internal teeth of the other of said gear of said second group and said third selecting gear;

whereby said selecting shaft is prevented from being erroneously moved between said second group of said selecting gears and said third selecting gears.

3. A type character selecting mechanism as claimed in claim 2, wherein said characters borne on said outer printing elements of said two outer selecting gears are of a nature that they are not frequently changed and wherein said type characters borne on both said printing elements of said two intermediate selecting gears as well as of said inner selecting gears are of a nature that they are frequently changed.

4. A type character selecting mechanism as claimed in claim 3, wherein the external teeth of the two outer selecting gears which are rotatable with said two outer printing elements are rotatably displaced with respect to their inner teeth, and wherein the external teeth of the intermediate and inner selecting gears for said intermediate and inner printing elements are rotatably and radially aligned with the inner teeth of said gears.

5. A type character selecting mechanism as claimed in either of claims 1 or 3, wherein said positioning means includes a plurality of positioning notches formed at the outer edges of the outer teeth of said two intermediate selecting gears;

and a pair of positioning forks each having two flexible pawls which are positioned and sized to engage with two of said positioning notches of one of said intermediate selecting gears for positioning said intermediate selecting gears at a half pitch position such that the inner teeth thereof are registered with those of the adjacent one of said two outer selecting gears, whereby the locking member of said selecting shaft can be moved therebetween.

6. A type character selecting mechanism as claimed in claim 2, wherein said printing elements are endless bands each of which is formed on its inner side with a series of engagement grooves and bands positioned and sized to engage with the external teeth of each of the corresponding selecting gears so that each band can be turned by its associated selecting gear.

7. A type character selecting mechanism as claimed in claim 6, further comprising a rotatable positioning member formed with engagement grooves which are positioned and sized to engage with the engagement bands of the corresponding one of said endless bands for positioning; said positioning member being biased toward said endless band to hold it stationary to position the selected type character for printing; a resilient lock for holding said member in position; and biasing means for biasing said elastic lock into engagement with said positioning member.

8. A type character selecting mechanism for a printing head including a plurality of printing elements juxtaposed to one another and each bearing a series of type characters on its outer surface comprising: a plurality of annular selecting gears substantially coaxially juxtaposed to one another and rotatable about their common axis with the printing elements of said printing head, respectively; coaxially aligned holes defined in said selecting gears; each of said selecting gear holes defining an inner side of said gear and each said inner side having a plurality of equidistantly spaced internal teeth;

a selecting shaft slidable through said coaxial holes of said selecting gears and rotatable about the axis of said selecting shaft, said shaft having thereon a locking member which is positioned and sized to engage with and which engages said internal teeth of a selected one of said selecting gears, whereby rotation of said selecting shaft rotates the said gear then engaged by said locking member;

a first of said selecting gears having a first rotative orientation, at which its said internal teeth are axially aligned with the said internal teeth of a second group of said selecting gears, and having a second rotative orientation, at which its said internal teeth are angularly displaced from the said internal teeth of said second group of said selecting gears; and positioning means for locking said first selecting gear at either of said first and second rotative orientations;

a third one of said selecting gears having its said internal teeth normally angularly displaced from said internal teeth of said second group of said selecting gears; at said second rotative orientation of said first selecting gear, said internal teeth of said first selecting gear are axially aligned with said internal teeth of said third selecting gear;

said first selecting gear being positioned between a said selecting gear of said second group and said third selecting gear, whereby movement of said locking member from one of a said gear of said second group and said third gear, which is located on one side of said first gear, to the other of a said gear of said second group and said third gear, which is located on the opposite side of said first gear, requires rotation of said first gear to said rotative orientation thereof at which said teeth of said first gear are axially aligned with the said teeth of the respective one of said gear of said second group and said third gears in which said locking member is located, shifting of said locking member into said internal teeth of said first gear, and then rotation of said first gear to the said rotative orientation thereof at which said internal teeth of said first gear are axially aligned with the said internal teeth of the other of said gear of said second group and said third gear into which said locking member is to be moved, and then shifting said locking member into said internal teeth of the other of said gear of said second group and said third selecting gear.

9. A type character selecting mechanism as claimed in either of claims 2 or 8, wherein when said third gear internal teeth and said second gear internal teeth are axially misaligned, the corresponding said printing elements thereon are directed in the same respective directions.

10. The type character selecting mechanism of claim 9, wherein said external teeth of one of said second and said third selecting gears being rotatably displaced from said internal teeth thereof, and said external teeth of the other of said second and said third selecting gears being rotatably generally aligned with said internal teeth thereof.

11. A type character selecting mechanism of claim 10, wherein said positioning means includes notches formed in said outer teeth of said first gear, whereby said first gear effectively thereby has external teeth spaced half the distance apart of the spacing of said external teeth of said second and said third gears;

a pawl supported for engaging said external teeth and notches of said first gear, whereby said pawl may halt rotation of said first gear at any position defined by one of a said notch and a said external tooth of said first gear, for defining, respectively, the said first and second rotative orientations of said first gear.

12. A type character selecting mechanism of claim 10, wherein the two outer said selecting gears of the said juxtaposed plurality are said third selecting gears; the two intermediate said selecting gears, inside of and respectively adjacent the said two outer selecting gears, are said first selecting gears; and the inner said selecting gears inside of and respectively adjacent said two intermediate gears are said selecting gears of said second group.

13. A type character selecting mechanism of any of claims 2, 3 or 8, wherein said positioning means includes notches formed in said outer teeth of said first gear, whereby said first gear effectively thereby has external teeth spaced half the distance apart of the spacing of said external teeth of said second and said third gears;

a pawl supported for engaging said external teeth and notches of said first gear, whereby said pawl may halt rotation of said first gear at any position defined by one of a said notch and a said external tooth of said first gear, for defining, respectively, the said first and second rotative orientations of said first gear.

14. A type character selecting mechanism either of claims 2 or 8, wherein the two outer said selecting gears of the said juxtaposed plurality are said third selecting gears; the two intermediate said selecting gears, inside of and respectively adjacent the said two outer selecting gears, are said first selecting gears; and the inner said selecting gears inside of and respectively adjacent said two intermediate gears are said selecting gears of said second group.

15. A type character selecting mechanism as claimed in claim 2, wherein said positioning means includes notches formed in said outer teeth of said first gear, whereby said first gear effectively thereby has external teeth spaced half the distance apart of the spacing of said external teeth of said second and said third gears;

a pawl supported for engaging said external teeth and notches of said first gear, whereby said pawl may halt rotation of said first gear at any position defined by one of a said notch and a said external tooth of said first gear, for defining, respectively, the said first and second rotative orientations of said first gear.

* * * * *